US006213265B1

(12) United States Patent
Wang

(10) Patent No.: US 6,213,265 B1
(45) Date of Patent: Apr. 10, 2001

(54) TRUNK WITH TELESCOPIC ROD AND FOR PLACING FURNACE

(76) Inventor: Jin-Chiao Wang, No. 18, Lane 116, Ta An Kang Rd., Ta-Chiao Chen, Taichung Hsien (TW)

( * ) Notice: Subject to any disclaimer, the term of this patent is extended or adjusted under 35 U.S.C. 154(b) by 0 days.

(21) Appl. No.: 09/629,866

(22) Filed: Aug. 1, 2000

(51) Int. Cl.[7] ..... A45F 3/00
(52) U.S. Cl. ..... 190/11; 190/18 A; 290/37
(58) Field of Search ..... 190/11, 12 A; 280/37; 108/15

(56) References Cited

U.S. PATENT DOCUMENTS

| | | | | |
|---|---|---|---|---|
| 244,898 | * | 7/1881 | Hoskins | 206/541 |
| 537,178 | * | 4/1895 | Blalock | 206/541 |
| 2,019,522 | * | 11/1935 | Colross | 190/11 |
| 3,516,523 | * | 6/1970 | Pemberton, Jr. | 190/11 |
| 3,557,916 | * | 1/1971 | Stowell | 190/11 |
| 4,034,518 | * | 7/1977 | Trecker | 190/11 |
| 4,934,549 | * | 6/1990 | Allen | 190/11 |
| 5,730,282 | * | 3/1998 | Burean | 190/11 |
| 5,941,352 | * | 8/1999 | Lee | 190/11 |

* cited by examiner

*Primary Examiner*—Joseph M. Moy
(74) *Attorney, Agent, or Firm*—Bacon & Thomas, PLLC

(57) ABSTRACT

A trunk with a telescopic rod and for placing a furnace comprises a hollow housing. The outer side of the housing has a hole and a sliding wheel. Further, two sides of the housing are formed with respective movable handles. A hollow casing is installed with the housing. Near the top of the casing, the front and rear sides of the outer rim are protruded with combining blocks; each combining block is protruded with a post. A cover covers on the casing and a portable handle is pivotally installed in the through hole by a pin. Two movable tables are formed with combining grooves at positions with respect to the combining blocks of the casing. A telescopic rod is installed at a middle portion of one movable table. Another movable table is formed with a furnace groove for receiving a furnace. An outer periphery of the furnace groove is formed with a heat-isolating rim. A top lid is formed on the furnace groove for dust-proof.

2 Claims, 9 Drawing Sheets

TRUNK WITH TELESCOPIC ROD AND FOR PLACING FURNACE

BACKGROUND OF THE INVENTION

The present invention relates to a trunk with a telescopic rod and for placing a furnace, in which a telescopic rod and a furnace groove are installed on two movable tables for being pushed or pulled and placing a furnace.

Since the improvement of human life and progress in economics, peoples have more leisure times, and thus travelling outdoors becomes more and more popular. However, in order to travel outdoors, a proper trunk is necessary to receive articles, such clothes, small tables, etc. Therefore, a trunk with tables and for receiving articles is inventive. However, the prior art trunk has a handle at the lateral side, and thus if it is too heavy, then much force is required to take it up. Furthermore, the tables at two sides only have the function of receiving articles. In other words, the prior art trunk is dull and only has a few functions.

Therefore, a conventional trunk can not suit for the user's requirements, and a novel trunk is necessary to improve the defects in the prior art.

SUMMARY OF THE INVENTION

Accordingly, the primary object of the present invention is to provide a trunk with a telescopic rod and for placing a furnace, in which a telescopic rod and a furnace groove are installed on two movable tables for being pushed or pulled and placing a furnace.

In order to achieve the aforesaid object, the present invention provides a trunk with a telescopic rod and for placing a furnace comprises a hollow housing; the outer side of the housing has a hole and a sliding wheel; further, two sides of the housing are formed with respective movable handles. A hollow casing is installed with the housing; near the top of the casing, the front and rear sides of the outer rim are protruded with combining blocks; each combining block is protruded with a post, A cover covers on the casing and a portable handle is pivotally installed in the through hole by a pin. Two movable tables are formed with combining grooves at positions with respect to the combining blocks of the casing. A telescopic rod is installed at a middle portion of one movable table. A further movable table is formed with a furnace groove for receiving a furnace. An outer periphery of the furnace groove is formed with a heat isolating rim. A top lid is formed on the furnace groove for dust-proof.

The various objects and advantages of the present invention will be more readily understood from the following detailed description when reading in conjunction with the appended drawing.

DETAILED DESCRIPTION OF THE PREFERRED EMBODIMENTS

Figure 1:
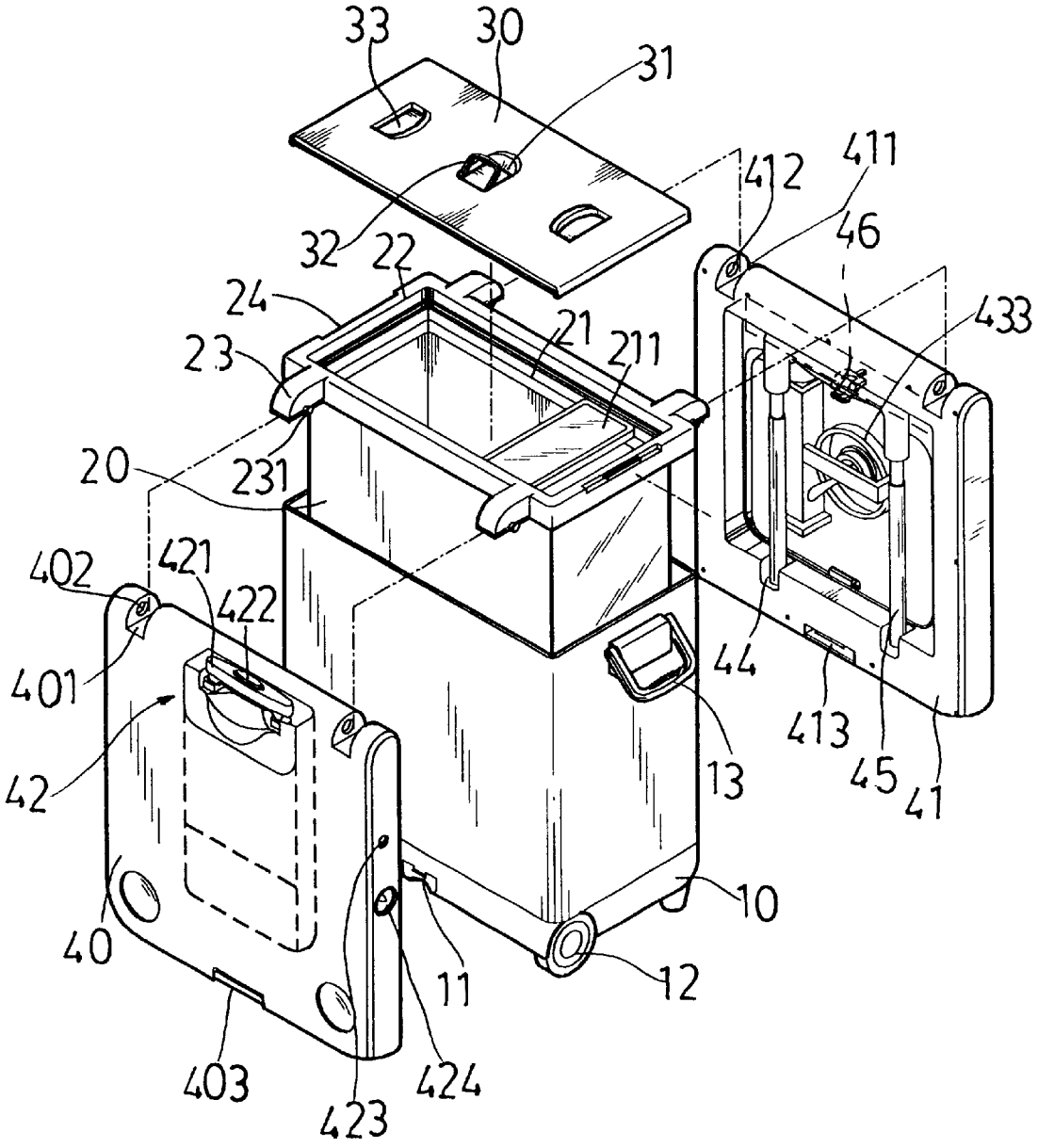
FIG. 1 is an exploded perspective view of the present invention.
Figure 2:
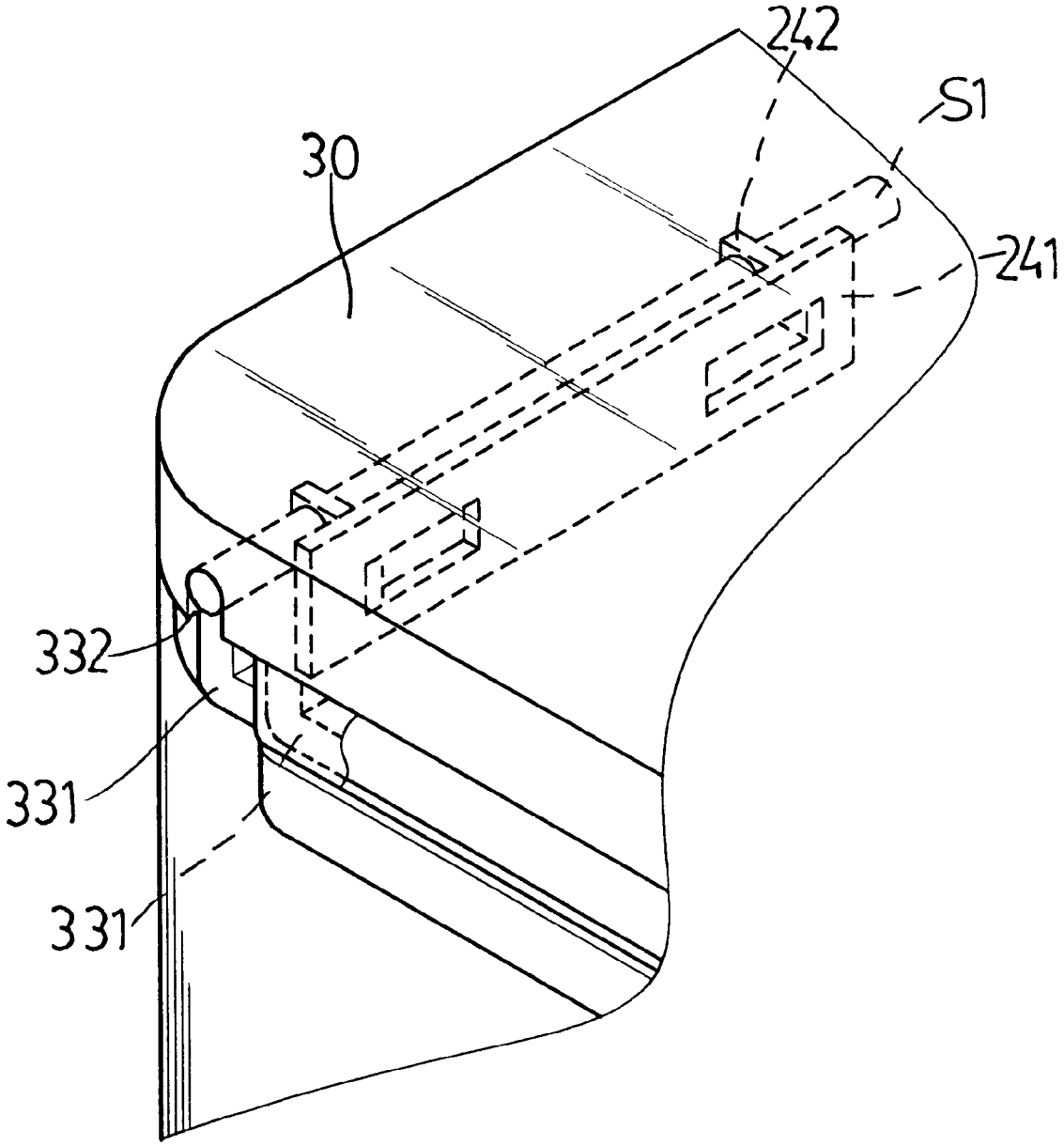
FIG. 2 is an enlarged schematic view of the cover in the present invention.
Figure 3:
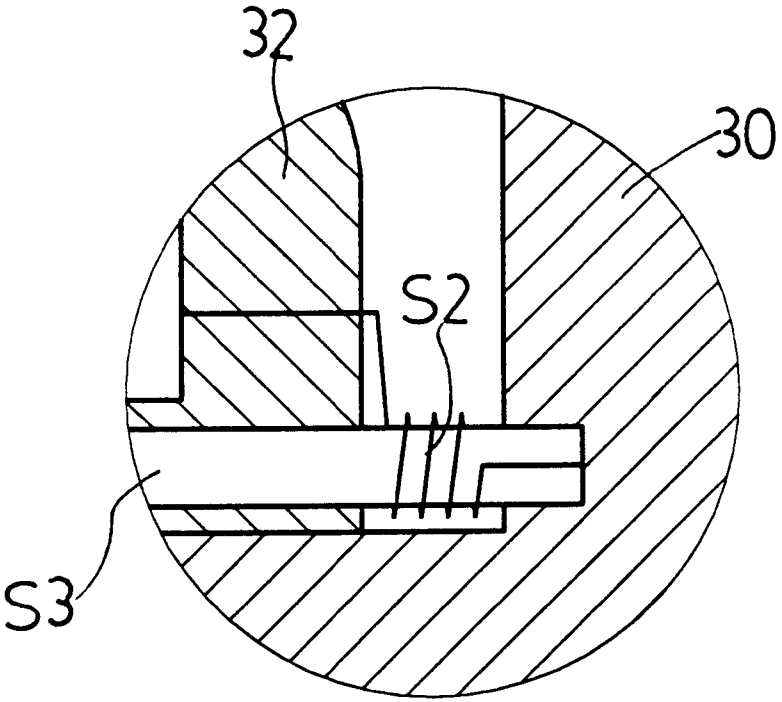
FIG. 3 is a cross sectional view of the movable handle in the present invention.
Figure 6:
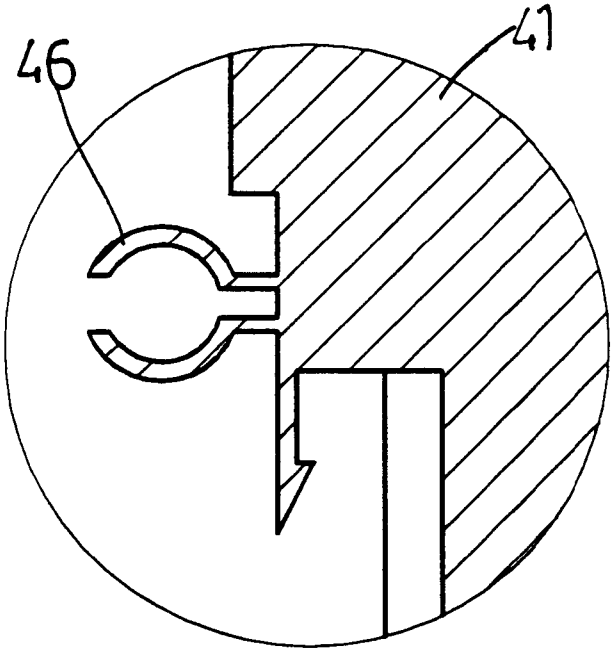
FIG. 6 is a cross sectional view of the buckling ring in the present invention.
Figures 4A, 4B:
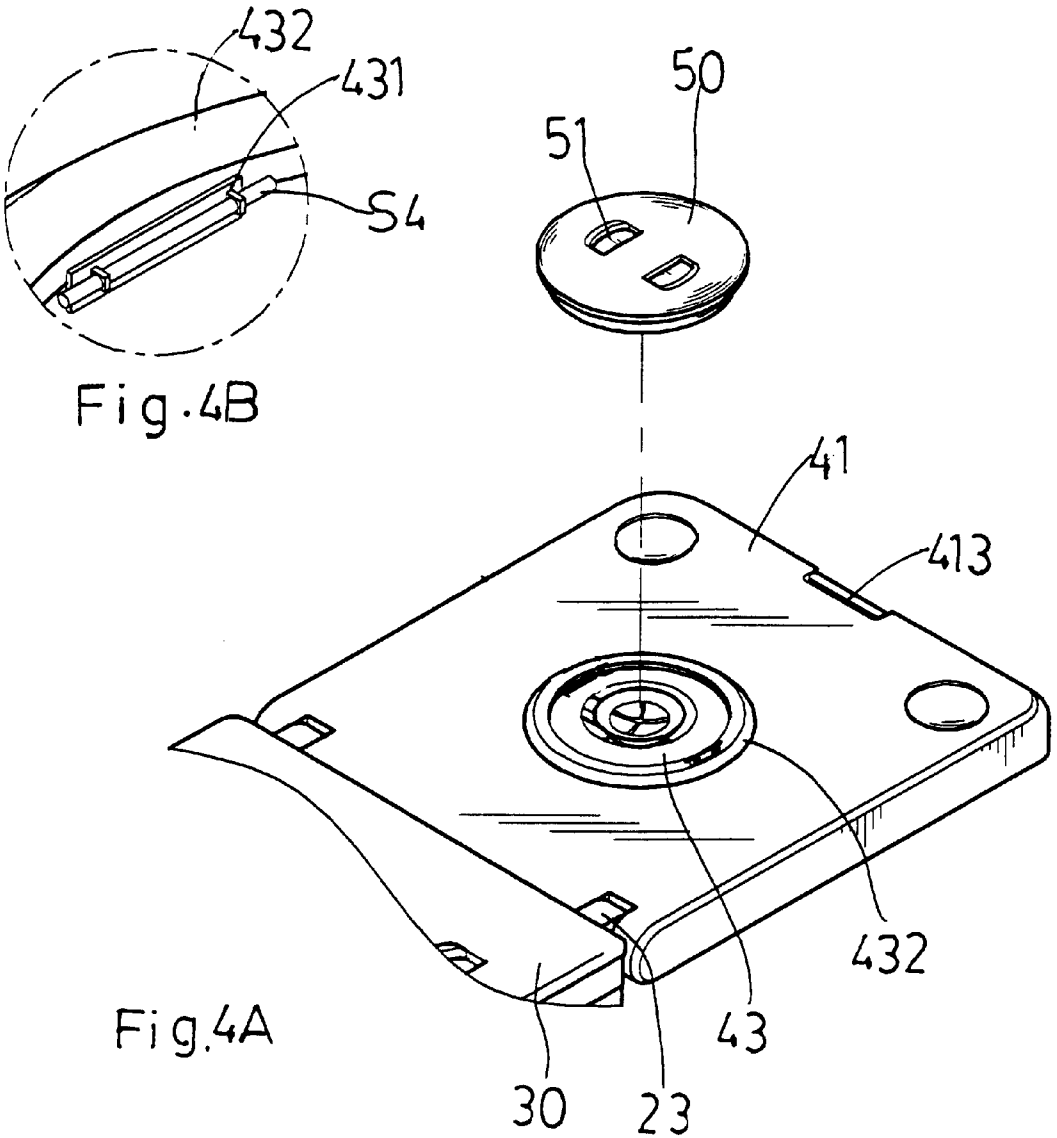
FIG. 4A is a schematic view of the movable table and furnace groove in the present invention.
FIG. 4B is an enlarged schematic view showing the combining portion of the present invention.
Figure 5:
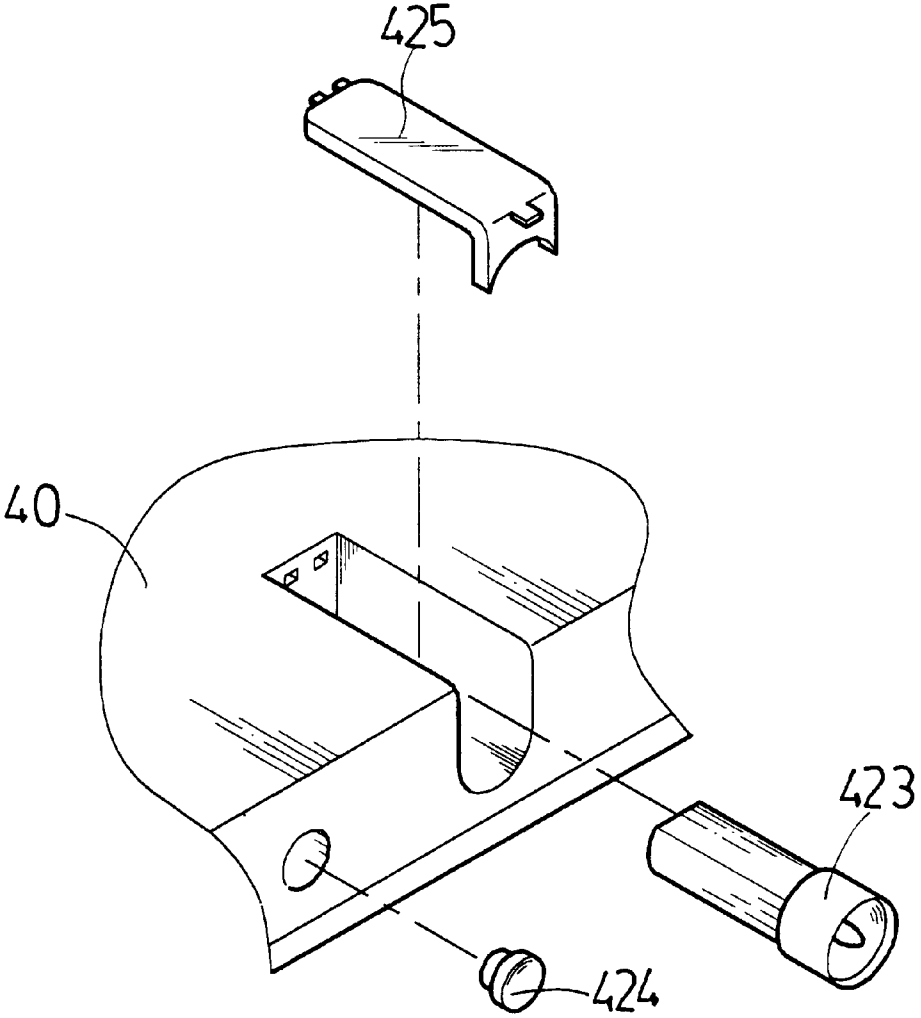
FIG. 5 is an elevation schematic view of the illuminator of the present invention.

The preferred embodiment of the present invention will be described in the following with the appended figures.

With reference to FIGS. 1 to 9, a trunk with a telescopic rod and for placing a furnace according to the present invention will be described herein.

In the trunk of the present invention, a hollow housing 10 is installed. The outer side of the housing 10 has a lower end the center of which is installed with a hole 11. Two sides of the hole 11 are firmly secured with sliding wheels 12, respectively, at positions with respect to the two corners of the lower end of the housing 10. Further, two sides of the housing 10 are formed with respective movable handles 13.

A hollow casing 20 is installed with the housing 10. The top of the inner side of the casing 20 is formed with an inner rim 21. A movable receiving block 211 is formed on the inner rim 21. The top of the outer side of the casing 20 is protruded with an outer rim 22 around the casing 10. The front and rear sides of the outer rim 22 are protruded with combining blocks 23. each combining block 23 is protruded with a post 231. Two top sides of the casing 20 are formed with respective flanges 22 at the left and right sides of the casing. Each of the flange 22 is formed with a trench 24. A embedding block 241 is firmly secured to the trench 24. The embedding block 241 is installed with two embedding pieces 242. A pin S2 passes through the two embedding pieces 242.

A cover 30 covers on the casing 20. A through hole 31 is formed at the middle portion of the cover 30. A portable portion 32 is pivotally installed in the through hole 31 by the pin S2. A restoring spring S3 is firmly secured to the portable portion 32 and the pin S2. The right and left sides of the cover 30 are formed with respective control blocks 33. The hook 331 extends downwards from each control block 33. The lower end of each control block 33 is installed with a concave hole 332 at position with respective to the pin S1.

Two movable tables 40 and 41 are formed with combining grooves 401 and 411 at positions with respect to the combining blocks of the casing 30. Furthermore, each of the combining grooves 401 and 411 are installed with respective embedding holes 402 and 412 at positions with respect to the posts 231 of the combining block 23. Moreover, the two movable tables 40 and 41 are formed with two movable blocks 403, 413 at positions with respect to the hole 11 of the housing 10. Besides, a telescopic rod 42 is installed at a middle portion of one movable table 40. The telescopic rod 42 is formed with a handle 421. The handle 421 is protruded with a button 422 and the lateral side of the movable table 40 is hidden with an illuminator 423 and a switch 424. A lid 425 is installed on the illuminator 423.

Another movable table 41 is formed with a furnace groove 43. Two sides of the furnace groove 43 are installed with combining portions 431. A pin S4 is installed in the combining portion 431. The outer periphery of the furnace groove 43 is formed with a heat isolating rim 432. The lower side of the heat isolating rim is installed with a top lid 50. Two operable blocks 51 are formed on top lid 50. As the operable blocks 51 is moved inwards, the top lid 51 can be taken up. The inner sides of the two movable tables 40 and 41 are installed with two embedding grooves 44. A telescopic supporter 45 is pivotally installed within each embedding groove 44. Further, another side is formed with a buckling ring 46 for being embedded by the telescopic supporter 45.

Figure 7:
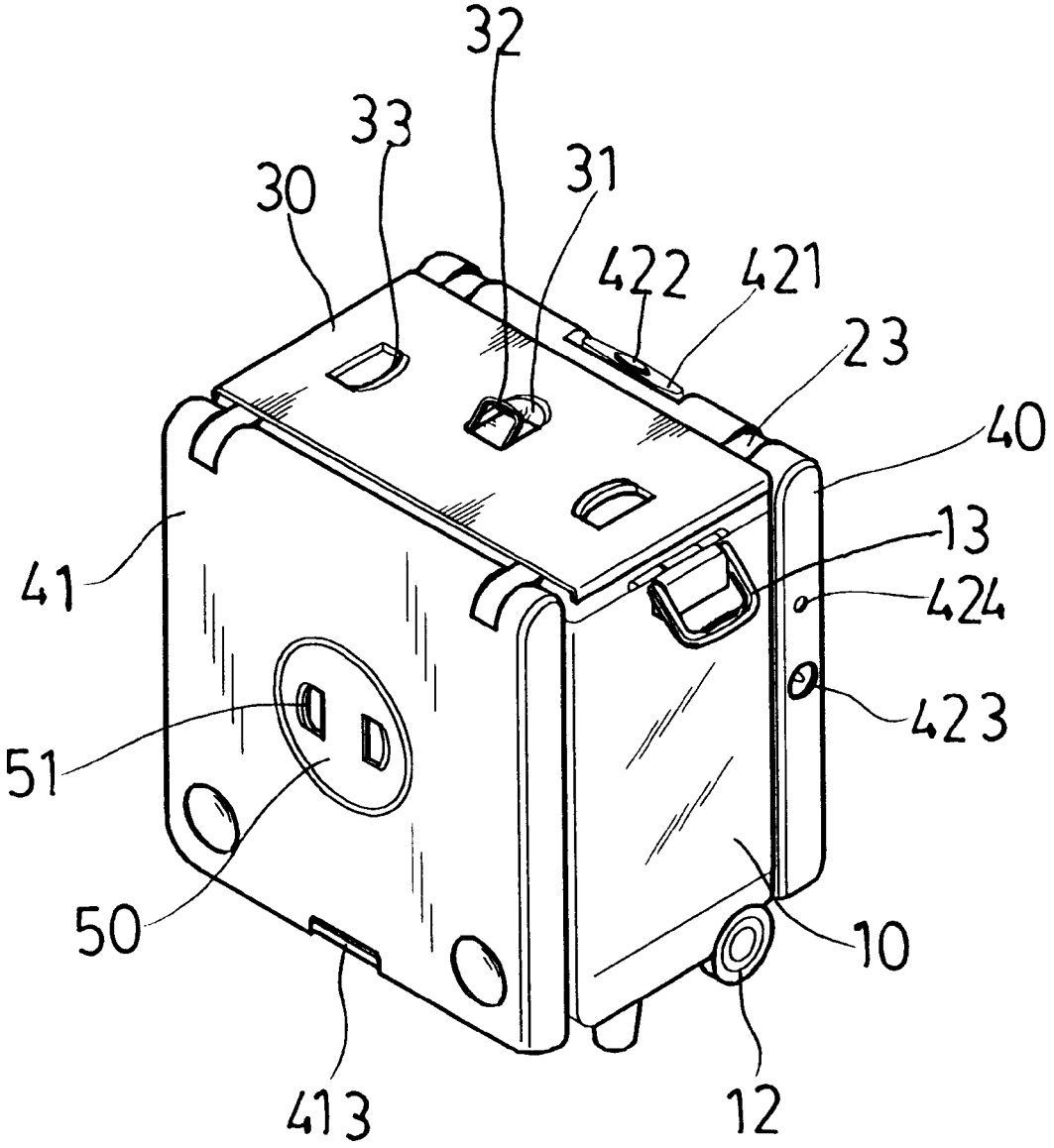
FIG. 7 is a perspective view of the present invention.

In assembly, as shown in FIG. 7, at first, the casing 20 is placed within the housing 10. When the cover 40 is desired to cover on the casing 20, the control block 33 on the cover 30 must be moved toward the center so that the hook 331 at the lower side will reduce inwards until the concave hole 332 is substantially buckled by the pin S1, and the control block 33 is released. Therefore, in one hand, the cover 30 can be firmly secured to the casing 20, and by the restoring spring S3, the movable handle 32 on the cover 30 is released, it is restored to the original place. The two movable tables 40 and 41 are pivotally connected to the posts 231 of the combining blocks 23 of the casing 20 by the embedding holes 402, 412 of the combining groove 401, 411 so that the two movable tables 40, 41 can be moved up or down as pleasure.

Figure 8:
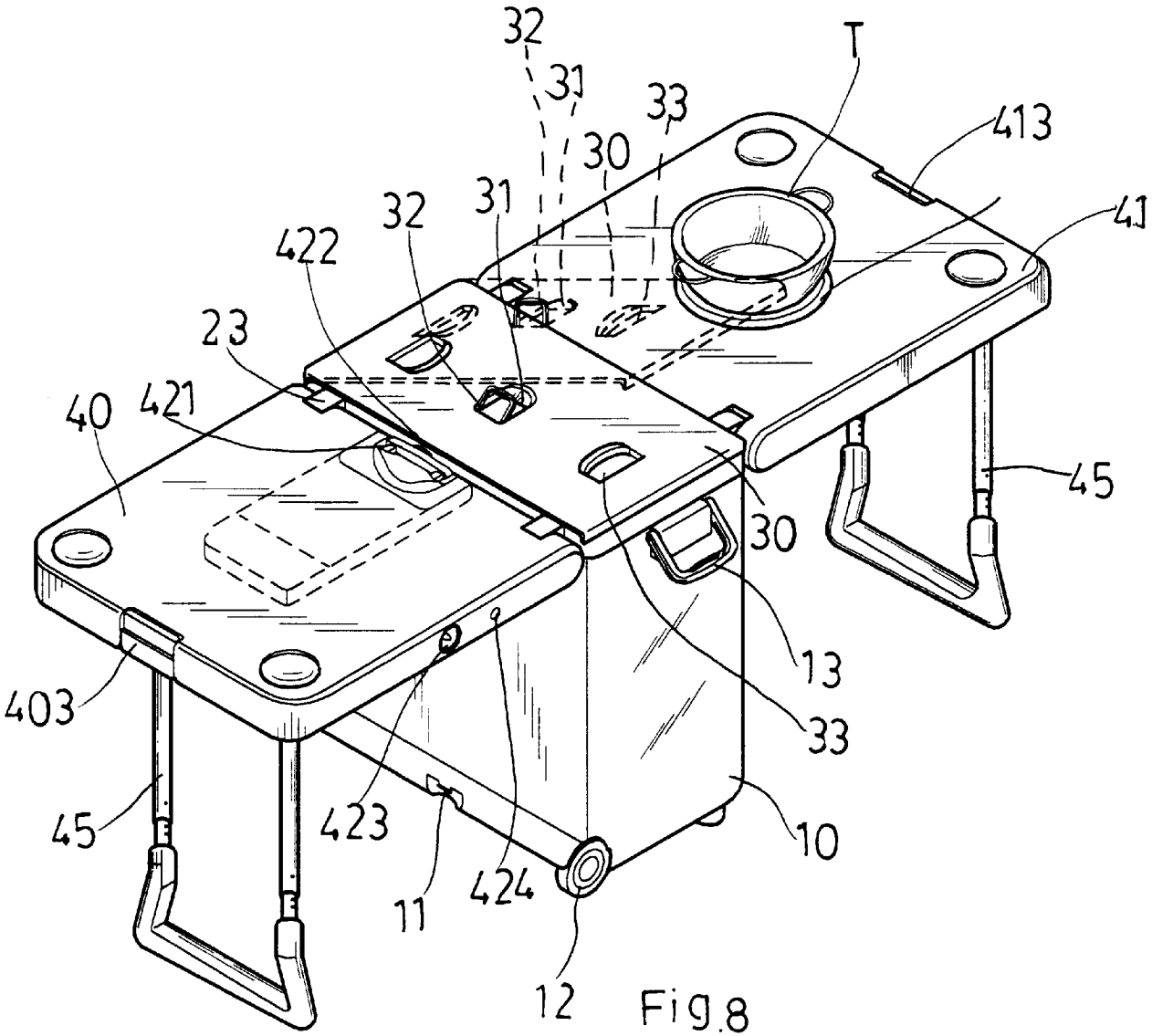
FIG. 8 is an expanding schematic view of the movable table in the present invention.

When it is desired to be used, the control block 33 at one side of the cover 30 can be moved to the center so that the hook 331 extending from control block 33 is reduced inwards. Thus, the hook 331 is released from the pin S1 and thus, the cover 30 can be opened at one side. If it is desired to take up the cover 30, the control blocks 30 at two sides must be moved to the center at the same time so that the hooks 33 below the control blocks 33 at two sides reduced inwards, and thus release from the pin S1 so as to take up the cover 30 successfully. If it is desired to expand the movable tables 40 and 41 at two sides, it is only necessary to move the movable plates 403 and 413 at two sides so as to separate from the hole 11 of the housing 10. Then, the two movable tables 40 and 41 can be opened successfully and the telescopic supporter 45 can be pulled toward the ground with a proper length. Then, the two movable tables 40 and 41 can be steadily supported in the ground, as shown in FIG. 8. The switch 424 at the lateral side of one movable table 40 can be pressed so as to open the illuminator 423. Thus, the present invention can be used in night.

Besides, a furnace T for baking or cooking can be placed in the furnace groove 43 of the movable table 41 at one lateral side of the present invention. If a gas switch 433 below the furnace groove 43 is actuated, then the user may cook or bake on the furnace. Therefore, the movable table 41 of the present invention is not only used to receive articles, but also have the function of cooking and baking. After it is not used, the top lid 50 covers on and flush with the furnace groove 43. The hooks 52 of the operable blocks 51 at two sides are buckled into the pin S4 of the combining portion 431. The using way is similar to the control blocks 33 on the cover 30, and thus the details will not be further described herein.

Figure 9:
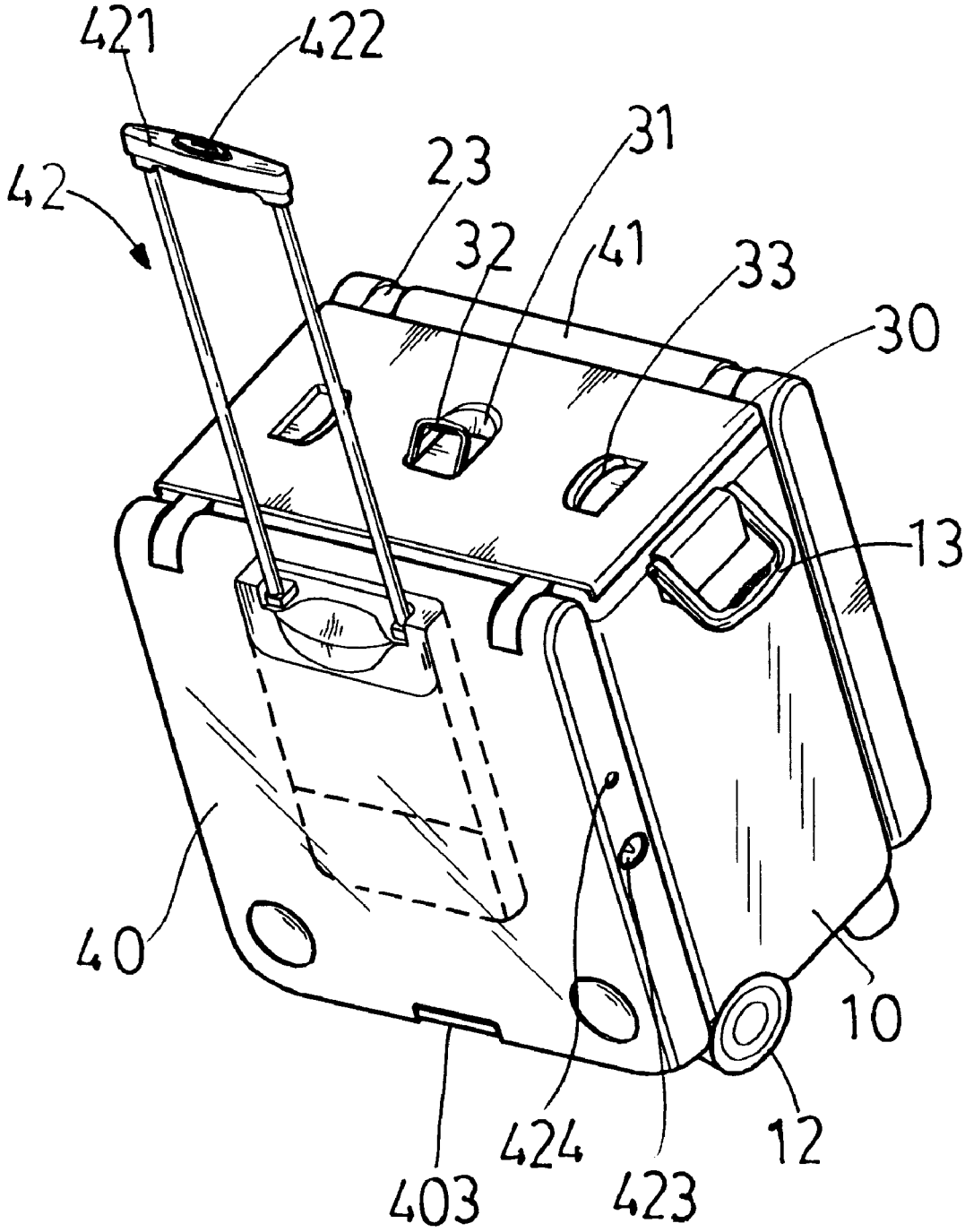
FIG. 9 is a schematic view showing the telescopic rod in the present invention.

The two movable tables 40 and 41 can be moved downwards so that the movable plates 403 and 413 are buckled to the hole 11. Then, the present invention is restored to receive article. By the telescopic rod 43 to press the button 422, a rod 423 can be pulled out, as shown in FIG. 9. With the sliding wheel 12, push and pull operations can be the performed.

Figure 10:
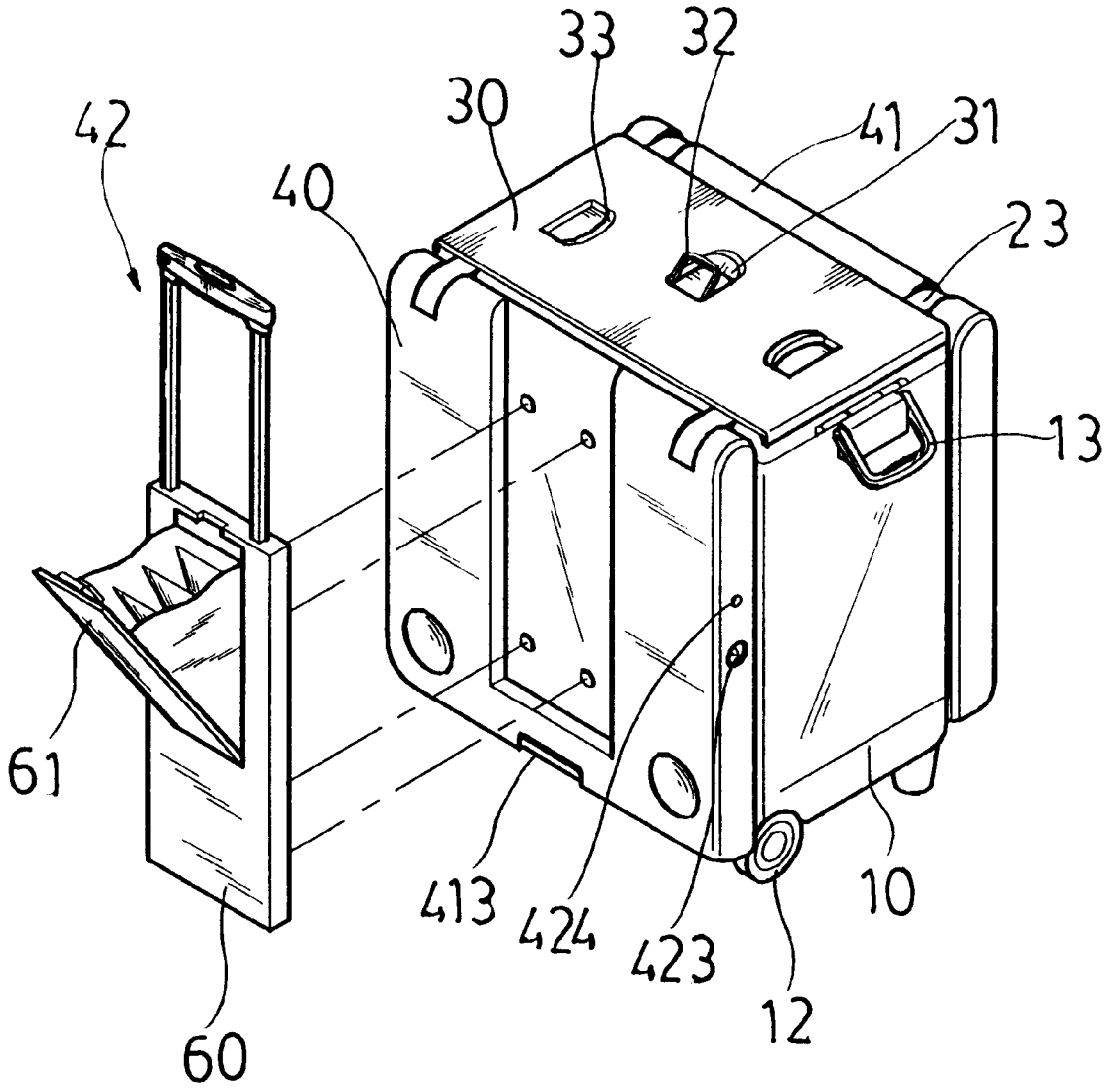
FIG. 10 shows another embodiment in the present invention.

Referring to FIG. 10, another embodiment of the present invention is illustrated. The telescopic rod 42 on one movable table 40 at one lateral side can be designed to be locked to the lateral side of the movable table 40 by a connecting block 60, and the connecting block 60 is installed with a storage chamber 61 for receiving articles. Thereby, the casing can be pushed or pulled.

In summary, the present invention has the following advantages:

Other then the movable tables 40 and 41, in the present invention, a furnace groove 43 can be installed at one movable table 41 so that not only having the function of receiving article, but also the present invention can be used to baking or cooking foods.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A trunk with a telescopic rod and for placing a furnace comprising:

a hollow housing; the outer side of the housing having a hole and a sliding wheel; further, two sides of the housing being formed with respective movable handles;

a hollow casing installed with the housing; near the top of the casing, an inner rim and an outer rim being formed; a receiving block being formed on the inner rim; the front and rear sides of the outer rim being protruded with combining blocks; each combining block being protruded with a post; two top sides of the casing being formed with respective flanges at the left and right sides of the casing; each of the flange being formed with a trench; an embedding block being firmly secured to the trench; the embedding block being installed with two embedding pieces; and a pin passing through the two embedding pieces;

a cover covering on the casing; a through hole being formed at the cover; a portable portion being pivotally installed in the through hole by a pin; a restoring spring being firmly secured to the portable portion and the pin; a right and a left side of the cover being formed with respective control blocks; a hook extending downwards from each control block; a lower end of each control block being installed with a concave hole at position with respective to the pin;

two movable tables being formed with combining grooves at positions with respect to the combining blocks of the casing; each of the combining groove being installed with respective embedding holes at positions with respect to the posts of the combining block; and two movable tables being formed with two movable blocks at positions with respect to the hole of the housing;

a telescopic rod being installed at a middle portion of one movable table; the telescopic rod being formed with a handle; the handle being protruded with a button and a lateral side of the movable table being hidden with an illuminator and a switch; and a lid being installed on the illuminator;

the other movable table being formed with a furnace groove; two sides of the furnace groove being installed with combining portions; a pin being installed in the combining portion; an outer periphery of the furnace groove being formed with a heat isolating rim; a lower side of the heat isolating rim being installed with a top lid; two operable blocks being formed on top lid; as the operable blocks being moved inwards, the top lid will be taken upwards; the inner sides of the two movable tables being installed with two embedding grooves; a telescopic supporter being pivotally installed within each embedding groove; and another side being formed with a buckling ring for being embedded by the telescopic supporters.

2. The trunk with a telescopic rod and for placing a furnace as claimed in claim 1, wherein the telescopic rod on one movable table at one lateral side is locked to a lateral side of the movable table by a connecting block, and the connecting block is installed with a storage chamber which can be opened outwards.

* * * * *